US006032567A

United States Patent [19]

Jones et al.

[11] Patent Number: 6,032,567

[45] Date of Patent: Mar. 7, 2000

[54] SURF ZONE MINE CLEARANCE

[75] Inventors: William Steven Jones, Panama City Beach; James Edwin Rumbough, Panama City, both of Fla.

[73] Assignee: The United States of America as represented by the Secretary of the Navy, Washington, D.C.

[21] Appl. No.: 09/048,834

[22] Filed: Mar. 16, 1998

[51] Int. Cl.[7] ..... B64D 1/04; B63G 9/00

[52] U.S. Cl. ..... 89/1.13; 102/402

[58] Field of Search ..... 89/1.13, 1.1; 102/402, 102/403, 364

[56] References Cited

U.S. PATENT DOCUMENTS

| | | | |
|---|---|---|---|
| H162 | 11/1986 | Sullivan, Jr. et al. | 102/403 |
| 3,789,759 | 2/1974 | Jones | 102/23 |
| 4,944,210 | 7/1990 | Flock et al. | 89/1.818 |
| 5,322,002 | 6/1994 | Miskelly, Jr. et al. | 89/8 |
| 5,437,230 | 8/1995 | Harris et al. | 102/302 |
| 5,598,152 | 1/1997 | Scarzello et al. | 340/850 |
| 5,661,258 | 8/1997 | Garcia et al. | 102/402 |
| 5,686,686 | 11/1997 | Woodall, Jr. et al. | 89/1.13 |
| 5,708,230 | 1/1998 | Woodall, Jr. et al. | 102/402 |

*Primary Examiner*—Charles T. Jordan
*Assistant Examiner*—Jeffrey Howell
*Attorney, Agent, or Firm*—Harvey A. Gilbert; Donald G. Peck

[57] ABSTRACT

A device for clearing obstructions from surf zones comprising an elongated generally cylindrical housing having a first end and a second end, the housing encasing a fuse positioned inside of the first end and a compartment containing a gas generating compound positioned inside of the second end, the fuse detonationally attached to the compound and being capable of causing the compound to initiate burn, the compound having a burn time which is capable of producing sufficient amounts of gas capable of rupturing the housing with the burning of the compound. A method for clearing obstruction which provides the device, interring the device within the subsoil proximate to the obstructions, and, detonating the compound wherein a burning of the compound forms sufficient amounts of gas to rupture the housing and sunder subsoil support of the obstructions effective to clear the obstructions also is disclosed.

20 Claims, 2 Drawing Sheets

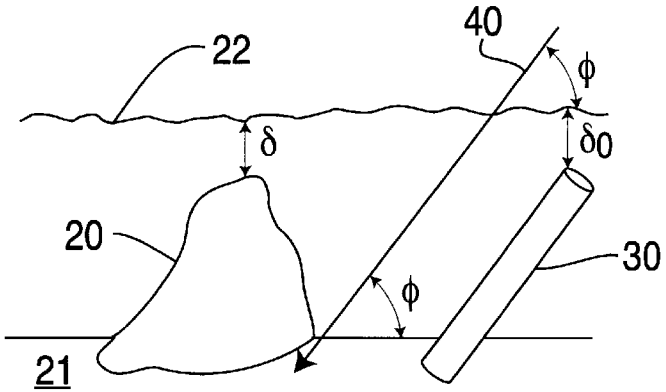
FIG. 3A
FIG. 3B
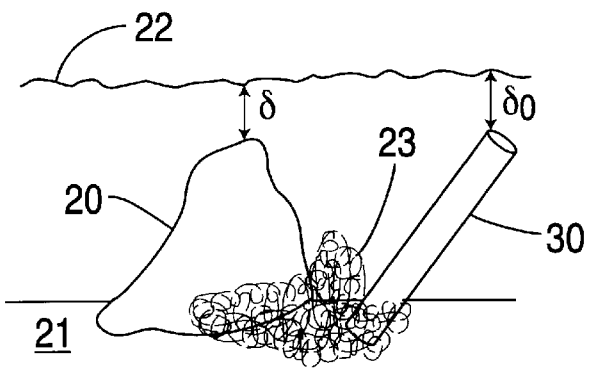
FIG. 3C
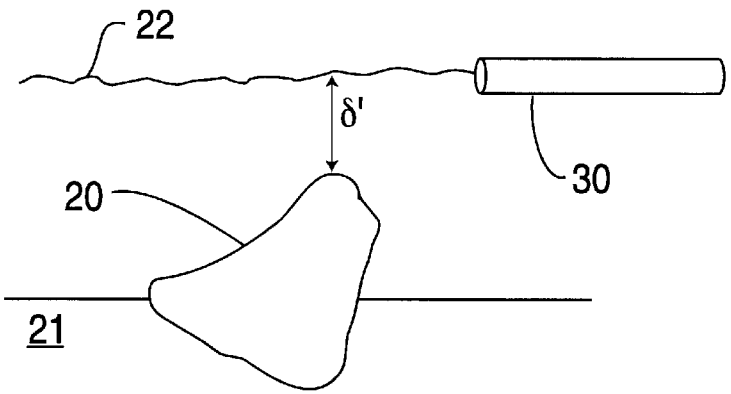
FIG. 3D

SURF ZONE MINE CLEARANCE

The invention described herein may be manufactured and used by or for the government of the United States of America for governmental purposes without the payment of any royalties thereon or therefor.

BACKGROUND OF THE INVENTION

1. Field of the Invention

The present invention generally relates to a device and method for clearing obstructions in surf zones. More particularly, the device and method relates to clearing obstacles and mines by sundering the subsoil beneath and alongside the obstructions in a surf zone, thereby eliminating subsoil support from beneath the obstruction, and causing the obstruction either to drop away from the surface of the water or to float away. Most particularly, the device and method facilitate successful amphibious operations by clearing obstructions within the transit path of landing vehicles and/or naval support vessels.

2. Description of the Related Art

Military amphibious assault operations require the movement of large numbers of troops and massive amounts of supplies into a confined shore area, such as a beach, over a short period of time. Generally, these amphibious assaults are conducted in areas occupied by opposing military forces. In defending against an amphibious attack, the opposing military forces may place non-explosives obstacles, such as artificial barriers or reefs, concrete cubes, log posts, steel hedgehogs, steel tetrahedrons, sea urchins, wire and the like, within the surf zone of an expected line of assault to impede efficient movement of landing craft traveling to the shore. In using man-made non-explosive obstacles, defending forces attempt to delay the amphibious assault and/or channelize an assault into a defended area. Interrupts in the movement of troops and supplies across the surf zone to the shore may result in a significant disadvantage, including loss of personnel and equipment, to the assaulting forces.

Additionally, amphibious assault operations may necessarily cross surf zone areas having naturally occurring obstacles within a transit path of assault boats to the shore. The obstacles may be coral, rocks, or other large objects or protrusions in the water which are hazardous to speeding landing craft carrying heavy equipment and troops. These naturally occurring obstacles protrude into the path of advancing landing craft, impeding their transit, possibly disabling or sinking the landing crafts and/or support vessels.

Another hazard to an amphibious assault operation is deployed mines. The removal of mines is a particularly difficult endeavor. Mines are conventionally used to impede the progress of military forces through an area, either sea or land. Used against an amphibious assault within a surf zone, mines are particularly troublesome for the successful completion of the assault. Selective placement of mines within the surf zone may hinder or halt the transit of landing craft to shore.

All of these obstructions, man-made non-explosive obstacles, naturally occurring obstacles and/or mines may force advancing troops to by-pass the most expeditious transit route through a surf zone, causing delays, loss of surprise, and/or the loss of a concentrated advancing amphibious force. With the loss of force concentration, an advancing force may receive high rates of casualties and/or lose military advantage against the defending forces.

Several approaches to obstacle and mine clearance are known. U.S. Pat. No. 5,661,258 (Garcia et al.) discloses an air-delivered ordnance explosive for clearing navigable sea channels. U.S. Pat. No. 5,598,152 (Scarzello et al.) discloses an underwater vehicle that detects possible mine locations and deposits mine-clearing explosives close-by. U.S. Pat. No. 5,437,230 (Harris et al.) discloses a standoff mine neutralization system using an unpowered air vehicle. U.S. Statutory Invention Registration no. H162 (Sullivan, Jr. et al.) discloses a system for wide-area mine clearance using multiple fuel-containing containers.

However, these approaches are deficient when used for surf zone operations. First, amphibious assault operations require an unannounced assault in a given area. By limiting the amount of time the enemy knows of the assault, enemy forces are denied preparation time to reposition armaments and defense positions during the amphibious onslaught. Second, rapid execution of the amphibious operation is required to deny a defending force use of its reserve forces. Third, the successful destruction of an obstruction with conventional explosives depends partly on the composition of the obstruction. Fourth, destruction of obstructions requires the detonation of high yield explosives. These explosives are dangerous to handle and move, complicating their use in training and operational use. Additionally, the high yield explosives are environmentally hazardous, further complicating training for the safe use of the explosives. Fifth, a device and method which are useful against man-made and natural obstacles are needed, because the rapidly evolving military situation before and during an amphibious assault may not allow the amphibious forces time to identify the particular type of obstruction. Sixth, high yield explosives create significant crater or berms along the subsoil surface which create hazards for landing vehicles within the surf zone. Accordingly, none of the identified techniques provide for reliable clearance of man-made non-explosive obstacles, naturally occurring obstacles and mines in surf zones during amphibious assault operations.

In view of the foregoing, improvements in clearing obstructions in surf zone areas have been desired. In addition to improved reliability of clearing both obstacles and mines from landing craft transit paths, it has been desired to provide a device which is relatively safe to deploy.

The present invention addresses these needs.

SUMMARY OF THE INVENTION

The present invention provides a device for clearing obstructions from surf zones. The device comprises an elongated generally cylindrical housing having a first end and a second end, the housing encasing a fuse positioned inside of the first end and a compartment containing a gas generating compound positioned inside of the second end, the fuse ignitionally attached to the compound and being capable of causing the compound to initiate burn, the compound having a burn time which is capable of producing sufficient amounts of gas capable of rupturing the housing. The device of the present invention may be used for military or civilian applications. The device may be placed at the desired detonation location by a swimmer or remote means, or may launched to the desired detonation location by a rocket mechanism.

Additionally, a method for clearing obstructions from a surf zone comprising the steps of providing the previously described device, interring the device within subsoil proximate to the obstructions, and, detonating the compound wherein a burning of the compound forms sufficient amounts of gas to rupture the housing and sunder subsoil support of the obstructions effective to clear the obstructions is disclosed.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIGS. 3A–3D show a schematic of the present invention lowering and clearing obstacles in a surf zone.

DETAILED DESCRIPTION OF THE PREFERRED EMBODIMENT

Figure 1:
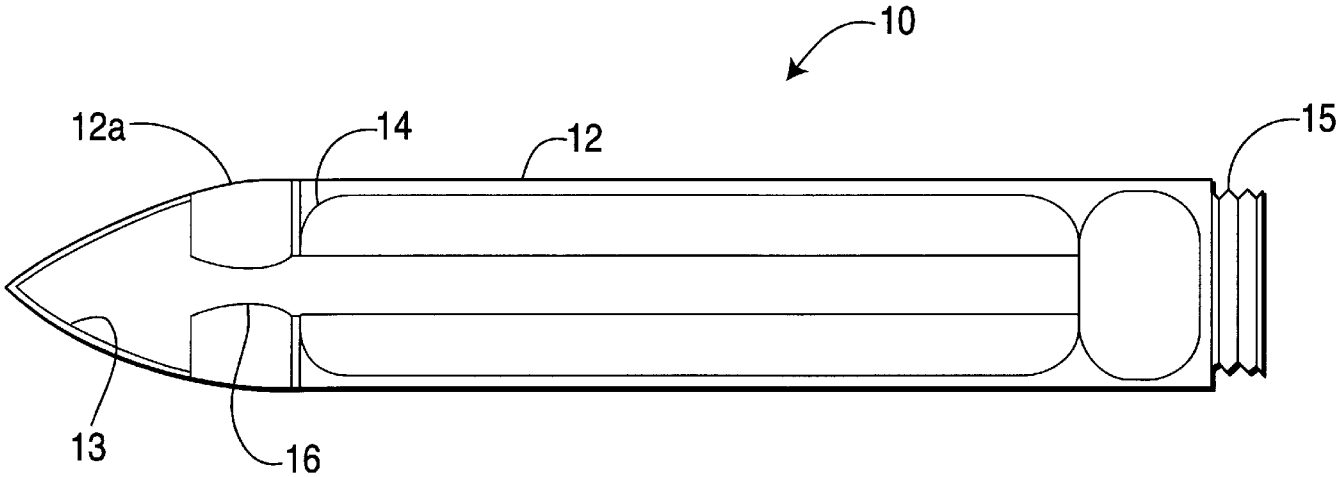
FIG. 1 is a side cross-sectional view of a preferred projectile for the present invention.

The present invention is a device and method for clearing obstructions from surf zones by sundering subsoil support from beneath and alongside the obstructions. By removing the supporting subsoil, the obstructions sink a sufficient depth for landing craft and vessels to transit over the obstructions to the shore or are otherwise cleared from the path of the landing craft and vessels.

The shore is any land mass adjacent to a body of water, such as beach, coast, cliffs, and the like, which is within an objective area of an amphibious assault. Within the adjacent water body, a surf zone exists having a subsoil bottom. Generally, surf zones exist between a combat amphibious force and a shore, or coast, where an amphibious attack is to occur. This is a distance of approximately three miles distance or less. More particularly, the surf zone is from about 5 meters to about 500 meters from the shore. The surf zone is considered that area which is too far from shore for a landing craft to disembark the troops and equipment on board, and close enough to the shore which allows objects within the water to impede the process of the landing craft and support vessels, which is generally at the line of surf formation along the shore. This generally occurs with a water depth of from about the high water mark to about a point of high tide mark, and may vary of from about 3 feet to about 20 feet. In this area, man-made and natural obstructions may impede the landing craft from reaching the shore, by grounding and/or sinking it. When grounded away from the shore, landing craft are useless to the advancing amphibious force and are at risk to enemy bombardment.

The subsoil may be any water bed material which is encountered by an amphibious assault force transiting to shore. This includes sand, coral, mud, light vegetation, other soft and semi-hard bottoms, and the like. Obstructions rest on top of or constitute part of the subsoil or may be buried therein.

Obstructions are any obstacles, man-made or naturally occurring, mines, protrusions, objects, and the like, which impede the movement of landing craft and support vessels through a surf zone area. Accordingly, obstructions must be of such shallow depth as to interfere with the transit of landing craft, vessels or support ships. In general, this includes depths which are of equal distance or less as the drafts of such vessels.

The obstructions are sunk by the present invention to a sufficient depth for landing craft and vessels to transit over the sunk obstruction and continue on to the shore. This includes obstructions such as artificial barriers or reefs, concrete cubes, steel hedgehogs, steel tetrahedrons, coral, rocks, sea urchins, wire and the like. Accordingly, the obstruction need only be sunk to a depth which is greater than the draft of the landing craft and/or support vessel that will transit in that surf zone area. The depth varies by the type of landing craft and support vessel used, but generally ranges from about 8 feet or less, more particularly from about 6 feet or less, most particularly 4 feet or less.

Additionally, by removing subsoil support form beneath an obstruction which has a specific gravity less than the surrounding water, the obstruction breaks away from the subsoil and floats away. This includes obstructions such as log posts and other timber objects, plastic materials, fabric materials and the like. The obstruction is freed from an "anchoring" subsoil support sufficient to allow free drifting. Current and surf conditions are factors which affect the amount of subsoil support removal in floating these obstructions.

In addition to military amphibious operations, the present invention is directed to civilian applications. Pier and seawall clearance, bridge piling removal and the like may be accomplished by the present invention. Generally, rocket delivery of the gas generating compound is not required or preferred. Accordingly, swimmers and remote means such as robots, mechanical arms and the like, are used to place the gas generating compound proximate to the obstructions. Preferably, the several devices are placed at specified intervals or stacked together reaching to the bottom of the obstruction. The swimmer and remote means may also be used in military operations to place the gas generating compound proximate to the obstructions, when combat conditions permit.

The present invention is considered to be located proximate to obstructions when that location provides for movement of the obstruction with the release of the gas. The location varies with the factors of subsoil type, depth, compound composition, charge design, obstruction composition, and the like, with these factors being known to those skilled in the art. More preferably, proximate locations are located beneath the obstructions, at approximately four feet depth in the subsoil, at a ½ distance between the edge of the obstruction and its center of gravity. Most preferably, proximate allows removal of the obstruction effective to permit amphibious assault operations over the obstruction area. However, multiple devices may be placed proximate to a single obstruction, with each device adding incrementally to the obstruction removal. Use of multiple devices allow a cascading sundering effect, and less explosive material within each device for a given obstruction.

Figure 2:
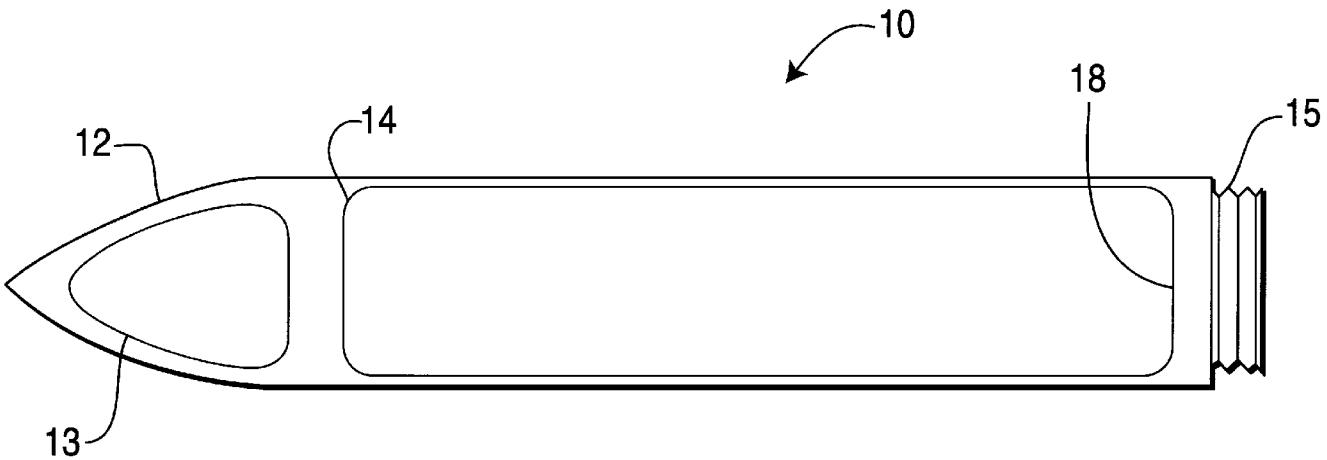
FIG. 2 is a side cross-sectional view of another embodiment of the invention.

As shown in FIG. 1, the device of the present invention comprises a generally cylindrical shape or projectile 10. The projectile 10 has a housing 12 made of any resilient material, such as metal, ceramic, other hard materials and the like, capable of withstanding firing or launch. The housing 12 has a frangible or rupturable portion 12*a* in one embodiment shown in FIG. 1 or a frangible or rupturable panel or wall 18, as shown in another embodiment in FIG. 2. The projectile 10 also has the capability of over-the-horizon firing or launching and the housing 12 must be sufficiently hard to withstand impact of the projectile 10 into the surf and to inter, or embed, into the subsoil without rupture from this distance, if needed. However, the distance may be any distance allowing accurate positioning of the projectile 10, preferably from about 50 miles or less, more preferably from about 20 miles or less, and most preferably from about 6 mile or less.

FIG. 1 also shows a fuse 13. The fuse 13 is shown in the forward section of the projectile 10 and must be capable of initiating a gas generating compound 14, which is a type of deflagration explosive. The fuse 13 may be of any construction as long as it is able to withstand projectile impact through the water and further down into the subsoil. The fuse 13 is timed to initiate burn once the projectile 10 is embedded in the subsoil. The fuse 13 is detonationally attached to the gas generating compound. The fuse 13 is located at the front of the warhead when a solid grain is used and at the rear of the warhead when a perforated grain gas generator compound 14 is used. A venturi 16 is used between the fuse 13 and the gas generating compound 14 to maintain the pressure in the section of the gas generator compound 14 above critical pressure level. Preferably, the fuse 13 is a time programmable delayed fuse. Fuse 13 ignition timing is dependent on the velocity of the impacting projectile 10 and the composition or type of subsoil in the surf zone area. Preferably, the time delay from subsoil impact to fuse 13 ignition is from about 0.1 seconds to about 10 seconds, more preferably from about 0.5 seconds to about 5 seconds, and most preferably from about 2 seconds to about 3 seconds. The fuses 13 have igniters. Preferably, the fuses 13 are modified M427 or M438, manufactured by General Dynamics of Burlington, Vt., replacing the explosive booster with an igniter.

The gas generating compound 14 shown in FIG. 1 is an explosive which produces excessive or large amounts of gas over a short period of time. Excessive or large amounts of gas are those amounts which are capable of effectively sundering an existing subsoil so as to create an increased depth or clearing of an obstruction thereon. Unlike high yield explosives which have burn rates of from about 5,000 to about 10,000 meters per second, gas generating compounds are slow burning. This slower release of gas increases the amount of released gas over the burn time of the explosive of from about 0.25 inches per second to about 4 inches per second, more preferably from about 0.5 inches per second to about 2 inches per seconds. Gas generation and the contingent pressures are relational to the rate of reaction of the chemical reaction of the gas generating compound 14. At an appropriate gas pressure, the frangible or rupturable front portion of housing 12 in one embodiment in FIG. 1, and the frangible or otherwise rupturable panel 18 in the embodiment shown in FIG. 2 permit release of the gas produced by compound 14. The gas generating compounds are designated as a class 1, subclass 5 or 6 (1.5 or 1.6) according to the publication Ammunition and Explosives Ashore Safety Regulations for Handling, Storing, Renovations and Shaping, Commander Naval Sea Systems Command, Mar. 1, 1995, page 7-2. High yield explosives are listed as 1.1 and 1.2. The size of the compartment containing the gas generating compound is preferably from about 10 inches to about 30 inches long, more preferably from about 15 inches to about 20 inches long. The volume of the compartment is preferably from about 40 $in^3$ to about 480 $in^3$, more preferably from about 60 $in^3$ to about 180 $in^3$. Gas generating compounds used in the present invention include compounds such as ammonium nitrate propellants, hydrazine based propellants, and similar compounds. Most preferably, the explosive is sodium azide. Gas generating compounds which permit the sunder of the subsoil for the present invention are known to those skilled in the art.

Obstruction clearance within surf zones by sundering the supporting subsoil beneath and alongside the obstruction permits use of gas generating compounds which do not have the environmental hazards of noise hazards to wildlife, heavy metals, hydrogen cyanide, hydrochloric acid, and the like. These gas generating compounds do not create craters and berms which are hazardous to assaulting forces in the amphibious operation. Gas generating explosives produce little to no noise, no heavy metals, and generate gases which are mostly carbon dioxide and nitrogen. Additionally, the gas generating compounds are safer to handle and move in comparison to high yield explosives. Accordingly, fewer accidents occur and the gas generating explosives may be more universally used, with training in the use of these explosives occurring more regularly, and reduced amounts of explosives may be used for clearing obstructions.

With gas generating compound 14, as compared to high yield explosives, the slower release of gases permits the sunder, or breaking apart, of the subsoil. This sunder may be characterized as a foaming, "fluidization" or liquidizing of the subsoil. In comparison, the compacted release of gas in high yield explosives tears subsoil particles away from each other. As the gases from the gas generating compound 14 are produced, the projectile 10 is ruptured, at frangible or rupturable portion 12*a* in FIG. 1 and frangible or rupturable panel 18 in FIG. 2, and the gases escape into the subsoil. The gases destabilize the subsoil, and cause a foaming effect. Formation of large amounts of gas sunder the subsoil support beneath the obstruction, thereby eliminating subsoil support from beneath the obstruction, causing the obstruction to fall into or break loose from the subsoil. When the obstruction has a specific gravity greater than the surrounding water, the weight of the obstruction forces it into the non-support area left by the escaping gases, thereby lowering the obstruction from the water surface and the depth of the obstruction increases to an amount sufficient to permit landing craft to pass over the obstruction and onto the shore. When the specific gravity of the obstruction is less than the surrounding water, the sundered subsoil releases the obstruction and the obstruction is allowed to float away.

The projectile 10 may be launched into the subsoil or placed there by a swimmer, remote arm, robot or the like. When the projectile 10 is launched into the subsoil, a rocket mechanism, or motor, 15 is used. The rocket mechanism 15 has the lift ability to propel the projectile 10 from the launch platform to the area of the obstructions in the surf zone. The rocket mechanism 15 also propels the projectile 10 sufficiently to penetrate through the water and into the subsoil. Preferably, the rocket mechanism 15 propels the projectile through a water depth of from about five feet or less, more preferably from about 8 feet or less, and most preferably ten feet or less. Additionally, the rocket mechanism 15 preferably propels the projectile 10 to penetrate into the subsoil from about 1 foot to about 8 feet, more preferably from about 2 feet to about 6 feet, most preferably from about 3 feet to about 4 feet. Any rocket motor which permits an accurate placement of the projectile 10 is contemplated in the present invention. Accuracy is preferably from about six meters or less, more preferably from about three meters or less, most preferably form about two meters or less distance from the obstruction. The rocket motor 15 is preferably a HYDRA 70 rocket motor by General Dynamic Ordnance Systems of Burlington, Vt. or the Boosted Kinetic Energy Penatrator (BKEP).

The projectile 10 may be launched or fired from a mobile or stationary platform in support of amphibious assault operations. The platforms include amphibious ships, landing craft, support or other sea-going vessels, oil platforms, low and high performance aircraft, land based launch systems and the like. These platforms are only required to be within the effective rocket range of the projectile 10. Preferably, the projectile 10 is launched from any launcher currently in military service. More preferably the projectile 10 is launched from a 2.75 inch rocket launcher. Most preferably, the projectile 10 is launched from a M260, M261 or ground based modified M261 launcher system, manufactured by Harvard Interiors of St. Louis, Mo. One or more projectiles 10 may be directed to a specific obstacle or a barrage of projectiles may be introduced to an obstacle location.

The device present invention may also not have a rocket motor 15 and be placed beneath or alongside an obstruction by a swimmer, remote means such as mechanical arms, extension rods, robots, and the like. Preferably, a hole is dug alongside and beneath the obstruction with the device placed therein. More preferably, several devices are placed alongside and beneath an obstruction. When delivered by a swimmer or remote means, the device comprises a delivery apparatus, which is designed to facilitate swimming or remote means movement, the design of the delivery apparatus known to those skilled in the art.

In operation, the device is delivered immediately before or during an amphibious assault. The device is launched from a platform, after which it travels over the surf zone and enters the water proximate to the obstruction. The projectile 10 travels through the water and is interred in the subsoil proximate to the base of the obstruction in the subsoil. Preferably, the projectile 10 enters the surface of the water and subsoil at an acute angle and stops directly underneath the obstruction. Alternatively, the projectile 10 enters the water surface at a 90° angle, to minimize deflection of the projectile 10 with either the water or subsoil surface. Once interred in the subsoil, the fuse 13 detonates and ignites the gas generating compound 14, allowing it to burn.

FIGS. 3A to 3D show the operation of the present invention. FIG. 3A shows an initial position of a rock obstruction 20 and log post obstruction 30 within a surf zone which has a subsoil 21 and water surface 22. The rock obstruction 20 has a specific gravity greater that the surrounding water and rests on the subsoil 21 with the subsoil 21 supporting the weight of the rock obstruction 20. The rock obstruction 20 has a depth of 6 from the water surface 22 in this initial position. Depth 6 is an amount less than the draft of a landing craft. Also shown in FIG. 3A, log post obstruction 30 has a specific gravity less than the surrounding water and is anchored in the subsoil 21. The depth of $\delta_o$ of log post obstruction 30 is an amount less than the draft of a landing craft.

In FIG. 3B, shows the placement of a projectile 10 into the subsoil 21, and beneath the rock obstruction 20. The projectile 10 travels along flight line 40, through the water surface 22, passing along the side of the rock 20 and log post 30 obstructions, into subsoil 21, with final placement in a proximate location beneath and alongside rock 20 and log post 30 obstructions. Preferably the projectile 10 enters the water surface 22 at an acute angle $\phi$ from the horizontal, to enter the subsoil 21 also at an acute angle $\phi$, allowing the projectile 10 to finally stop beneath and alongside the rock 20 and log post 30 obstructions.

As seen in FIG. 3C, once the projectile 10 is placed proximate to the rock 20 and log post 30 obstructions, the fuse 13 of the projectile 10 detonates and burns the gas generating compound, releasing large amounts of gas. Gas bubbles 23 sunder the subsoil 21 from beneath the obstruction 20. The subsoil 21 mixes with the evolving gas, dissipating and liquidizing the subsoil 21. Once the subsoil 21 is sundered, the gas bubbles 23 escape from beneath and alongside the obstructions 20 and 30, causing the subsoil 21 to foam and liquify. This foaming of the subsoil 21 causes the rock obstruction 20 to fall away from the water surface 22, and causes the log post obstruction 30 to be released and float away from the subsoil 21.

In FIG. 3D, the depth $\delta$ of the rock obstruction 20 increases to $\delta'$ as the rock obstruction 20 falls into the area of foamed subsoil 21. Depth $\delta'$ is a amount which is greater than the draft of a landing craft, allowing the landing craft to pass over the rock obstruction 20 along the water surface 22. Additionally, the foaming of the subsoil 21 release the log post obstruction 30 form the subsoil 21. Once released, the log post obstruction 30 floats to the water surface 22 and floats out of the path of the landing craft. The initial depth $\delta_o$ of the log post obstruction 30 is eliminated as a threat to the transiting landing craft.

As further seen in FIG. 3D, no craters, berms or voids are created in the subsoil 21 once the rock obstruction 20 and log post 30 obstructions are sunk and cleared from the path of the landing craft. Accordingly, no crater hazard remains for the landing vehicles coming ashore.

Additionally, multiple projectiles 10 may be used either launched as a unit, or in rapid succession. Factors to determine the appropriateness of multiple projectile 10 launches are known by those skilled in the art.

While there have been described what are presently believed to be the preferred embodiments of the invention, those skilled in the art will realize that changes and modifications may be made thereto without departing from the spirit of the invention. It is intended that the claims attached hereto include all such changes and modifications that fall within the true scope of the invention.

What is claimed is:

1. A device for clearing obstructions from surf zones comprising:

an elongated generally cylindrical housing having a first end and a second end;

a fuse positioned inside of said first end; and, a compartment containing a gas generating compound that burns positioned inside of said second end, said fuse detonationally attached to said compound and being capable of causing said compound to initiate burn, said compound having a bum time which is capable of producing sufficient amounts of gas to rupture said housing with the burning of said compound and effectively sundering adjacent subsoil.

2. The device of claim 1, further comprising a rocket mechanism attached to said second end of said device, said rocket mechanism being capable of propelling said device a distance from a platform and into said surf zone.

3. The device of claim 1, wherein said gas generating compound compartment has a length of from about 10 inches to about 30 inches long.

4. The device of claim 1, wherein said gas generating compound compartment has a volume of from about 40 $in^3$ to about 480 $in^3$.

5. The device of claim 1, wherein said gas generating compound is selected from the group consisting of ammonium nitrate propellants and hydrazine based propellants.

6. The device of claim 5, wherein said gas generating compound is sodium azide.

7. The device of claim 1, wherein said fuse is a time programmable delayed fuze.

8. A device for clearing obstructions from surf zones comprising:

an elongated generally cylindrical housing having a pointed first end and a second end;

a fuse positioned inside of said first end; and, a compartment containing a gas generating compound positioned inside of said second end, said fuse detonationally attached to said compound through a venturi and being capable of causing said compound to initiate burn, said compound having a burn time which is capable of producing sufficient amounts of gas capable of rupturing said housing with the burning of said compound.

9. The device of claim 8, further comprising a rocket mechanism attached to said second end of said device, said rocket mechanism being capable of propelling said device a distance from a platform and into said surf zone;

wherein said gas generating compound compartment has a length of from about 10 inches to about 30 inches long and a volume of from about 40 $in^3$ to about 480 $in^3$.

10. A device for clearing obstructions from surf zones comprising:

a housing having a first end and a second end;

a fuse positioned inside of said first end; and, a compartment containing a gas generating compound positioned inside of said second end, said fuse detonationally attached to said compound and being capable of causing said compound to initiate burn, said compound having a burn time which is capable of producing sufficient amounts of gas to rupture said housing with the burning of said compound and effectively sundering adjacent subsoil, wherein said gas generating compound burns at a rate of from about 0.25 inches/second to about 4 inches/second.

11. A method for clearing obstructions from a surf zones comprising the steps of:

(a) providing a device comprising an elongated generally cylindrical housing having a first end and a second end, said housing encasing a fuse positioned inside of said first end and a compartment containing a gas generating compound positioned inside of said second end, said fuse detonationally attached to said compound and being capable of causing said compound to initiate burn, said compound having a burn time which is capable of producing sufficient amounts of gas capable of rupturing said housing with the burning of said compound;

(b) interring said device within subsoil proximate to said obstructions; and, (c) detonating said compound wherein a burning of said compound forms sufficient amounts of gas to rupture said housing and sunder subsoil support of said obstructions effective to clear said obstructions.

12. The method of claim 11, comprising the step of interring said device within the subsoil at a depth of from about two feet to about six feet.

13. The method of claim 11, further comprising the step of launching said device from a platform.

14. The method of claim 13, further comprising the step of passing said device through water in the surf zone at an acute angle, and thereafter interring said device in said subsoil beneath and alongside said obstructions.

15. The method of claim 13, further comprising the step of launching said device from a 2.75 inch rocket launcher.

16. The method of claim 13, comprising the step of detonating said compound in a time interval of from about 0.1 second to about ten seconds after interring said device within said subsoil.

17. The method of claim 13, further comprising the step of clearing said obstructions by sinking said obstructions.

18. The method of claim 13, further comprising the step of clearing said obstructions by releasing said obstructions from said subsoil, thereby allowing said obstructions to float away.

19. The method of claim 11, comprising the step of interring said device by using a swimmer or remote means.

20. The method of claim 11, further comprising providing additional devices for clearing said obstructions.

* * * * *